US007374116B2

(12) United States Patent
Ishikawa et al.

(10) Patent No.: US 7,374,116 B2
(45) Date of Patent: May 20, 2008

(54) CIRCULATION TYPE MEDIA AGITATOR MILL

(75) Inventors: Tsuyoshi Ishikawa, Narashino (JP); Masakatsu Iioka, Narashino (JP); Toshihiro Ishii, Narashino (JP); Kaori Harigai, Narashino (JP)

(73) Assignee: Ashizawa Finetech Ltd., Chiba-Ken (JP)

( * ) Notice: Subject to any disclaimer, the term of this patent is extended or adjusted under 35 U.S.C. 154(b) by 0 days.

(21) Appl. No.: 11/297,763

(22) Filed: Dec. 8, 2005

(65) Prior Publication Data

US 2006/0261201 A1 Nov. 23, 2006

(30) Foreign Application Priority Data

May 17, 2005 (JP) ..... 2005-143377
Nov. 2, 2005 (JP) ..... 2005-319959

(51) Int. Cl.
*B02C 17/16* (2006.01)

(52) U.S. Cl. ..... 241/171; 241/172

(58) Field of Classification Search ..... 241/171–172; 366/299

See application file for complete search history.

(56) References Cited

U.S. PATENT DOCUMENTS 4,244,531 A * 1/1981 Szegvari ..... 241/172
5,333,804 A * 8/1994 Liebert ..... 241/69
5,791,569 A * 8/1998 Ishikawa ..... 241/74
2005/0224612 A1* 10/2005 Heinzelmann et al. ..... 241/172

FOREIGN PATENT DOCUMENTS

| | | |
|---|---|---|
| JP | H02-10699 | 3/1990 |
| JP | H02-61298 | 12/1990 |
| JP | H08-9017 | 1/1996 |
| JP | 3663010 | 4/2005 |

* cited by examiner

*Primary Examiner*—Faye Francis
(74) *Attorney, Agent, or Firm*—Renner, Kenner, Greive, Bobak, Taylor & Weber

(57) ABSTRACT

A circulation type media agitator mill includes a cylindrical vessel, and an agitating member arranged rotatably in the cylindrical vessel. A grinding media is contained in a grinding chamber defined between a cylindrical wall of the agitating member and a surrounding cylindrical wall of the vessel. A media-separating member is arranged coaxial with the agitating member in the inner space of the agitating member. An inlet is provided for leading material to be ground to the grinding chamber, and an outlet leads the material separated from the grinding media to the outside of the mill via the media separating member. The vessel may have a length to diameter ratio smaller than one. The cylindrical wall and hub of the agitatihg member have openings to allow the grinding chamber to communicate with the media separating chamber.

6 Claims, 9 Drawing Sheets

CIRCULATION TYPE MEDIA AGITATOR MILL

BACKGROUND OF THE INVENTION

The present invention relates to a circulation type media agitator mill. The circulation type media agitator mill in accordance with this invention is appropriate for grinding or dispersing into powder a variety of small pieces of material such as ink, paint, dying material, ceramic material, metal, inorganic material, ferrite, toner, glass or pigmented paper-coating material. These materials, however, should not be understood as restrictive.

Japanese Patent Publication No. H 02-10699 shows a conventional mill of the type which has being in practical use. It comprises: a mill body which includes a grinding chamber to be filled at least partly with grinding media and material to be ground and has an inlet for material to be ground and an outlet for crushed material, an agitator shaft having an inner shaft end inside the grinding chamber, and a separating means permitting finished pulverized material to flow out of the grinding chamber to the outlet yet retaining grinding media, wherein the agitator shaft has an end portion formed with a cavity therein which is open at the inner shaft end, the end portion of the agitator shaft includes recesses distributed around the cavity and spaced from the inner shaft end, through which said grinding media from said grinding chamber may axially flow into the cavity and through the inner shaft end to flow back into the grinding chamber, and the separating means is arranged at least substantially inside the cavity.

This type of mill is so designed that the material to be ground may remain an extended length of time in the mill, excluding any short cuts to the outlet. As a natural consequence, the quotient of the lateral length "L" divided by the diameter "D" of the vessel (L/D) is in the 3 to 4 range, as seen from FIG. 1 of the publication. This provides some disadvantages: if the material to be ground is high in viscosity, or if the bead-like grinding media is of relatively small sized pieces, the grinding media is apt to be driven toward the outlet, thereby preventing the even application of the crushing power to the "to be ground" material while being rubbed, and abnormal heat generation or wearing is caused. Sometimes, the mill may be overloaded in operation until it stalls. This problem grows noticeable more and more as the bead-like grinding media reduces less and less in particle size.

In the hope of preventing appearance of short cuts and making full use of the rotary energy it has been proposed that an annular space around the grinding vessel is used as the grinding chamber, but the problem of the grinding media being localized remains unsolved.

SUMMARY OF THE INVENTION

In view of the above, one object of the present invention is to provide an improvement in or relating to a circulation type media agitator mill, assuring that: the crushing power can be evenly used all over the grinding chamber; the mobility of the grinding media is good enough; and the crushing efficiency and the media separating efficiency are substantially improved, thus permitting the mill to work at high rotating speed.

To attain this object according to the present invention, a circulation type media agitator mill comprises: a cylindrical vessel; an agitating member arranged rotatably in the cylindrical vessel, the agitating member including a cylindrical wall and a hub closing one end of the cylindrical wall at periphery, the other end of the cylindrical wall being opened, grinding media contained in a grinding chamber defined between the cylindrical wall of the agitating member and a surrounding cylindrical wall of the vessel; a media-separating member arranged coaxial with the agitating member in the inner space of the agitating member; an inlet for leading material to be ground to the grinding chamber; an outlet for leading the material separated from the grinding media to the outside of the mill via the media separating member from the grinding chamber to the media separating chamber formed between the agitating member and the media separating member; and a circulation passage outside the mill, extending from the inlet to the outlet of the mill, in which the vessel is designed that the quotient of the length L1 divided by the diameter D of the vessel (L1/D) may be smaller than one. Preferably the quotient of L1/D is in the 0.3 to 0.4 range.

The cylindrical wall and hub of the agitating member may have a plurality of openings to make the grinding chamber communicate with the media separating chamber. The agitating member may have a plurality of oblique through holes made in the cylindrical wall, extending from the annular surface of the free end of the cylindrical wall to the rear surface of the hub of the agitating member.

The cylindrical vessel comprises a cylindrical barrel, an end plate fixed to one end of the barrel, and a frame fixedly arranged on the other end of the barrel. A rotary drive shaft is fixed by one end to the agitating member, and the other end of the shaft preferably extending through the frame of the cylindrical vessel.

Preferably the media-separating member may be a cylindrical screen or vaned wheel. The cylindrical screen may be fixed to the end plate, extending into the inner space of the agitating member, and then, the outlet is preferably provided on the side of the end plate. In case of the vaned wheel used as the media-separating member, the outlet can be also provided on the side of the end plate.

The inlet for the "to be ground" material is preferably placed behind the agitating member. Also, preferably the cylindrical vessel has a plurality of baffles laid on its inner cylindrical wall surface.

In a circulation type media agitator mill according to the present invention the quotient of the length L2 of the media separating chamber divided by the length L1 of the vessel (L2/L1) is preferably in the 0.4 to 0.7 range. The quotient of the annular width d1 of the grinding chamber divided by the annular width d2 of the media separating chamber (d2/d1) is preferably in the 0.5 to 2 range.

In a circulation type media agitator mill according to the present invention the vessel's lateral length-to-diameter ratio is smaller than one, which effectively prevents the bead-like grinding media from deviating toward the shaft of the agitating member; the grinding chamber surrounds the media separating chamber, which makes it difficult for the bead-like grinding media to approach the media separating chamber; and the media separating chamber communicates with the surrounding grinding chamber by a plurality of openings, which effectively increases the mobility of the bead-like media, thus lowering the deviation of the media and assuring the even application of the rubbing force to the pulverized material to be ground. The openings made in the hub of the agitating member effectively increases the mobility of the bead-like grinding media in the axial direction.

Separation of the bead-like grinding media can be effectively done by selectively using the screening cylinder or the centrifugal vaned wheel in respect of whether the grinding media is of high or low viscosity. The baffles which are laid on the inner wall surface of the cylindrical vessel effectively to prevent the bead-like grinding media from slipping on the inner circumference of the vessel, and accordingly the crushing efficiency can be improved.

Other objects and advantages of the present invention will be understood from a few preferred embodiments of the present invention, which are shown in accompanying drawings:

PREFERRED EMBODIMENTS

Figure 1:
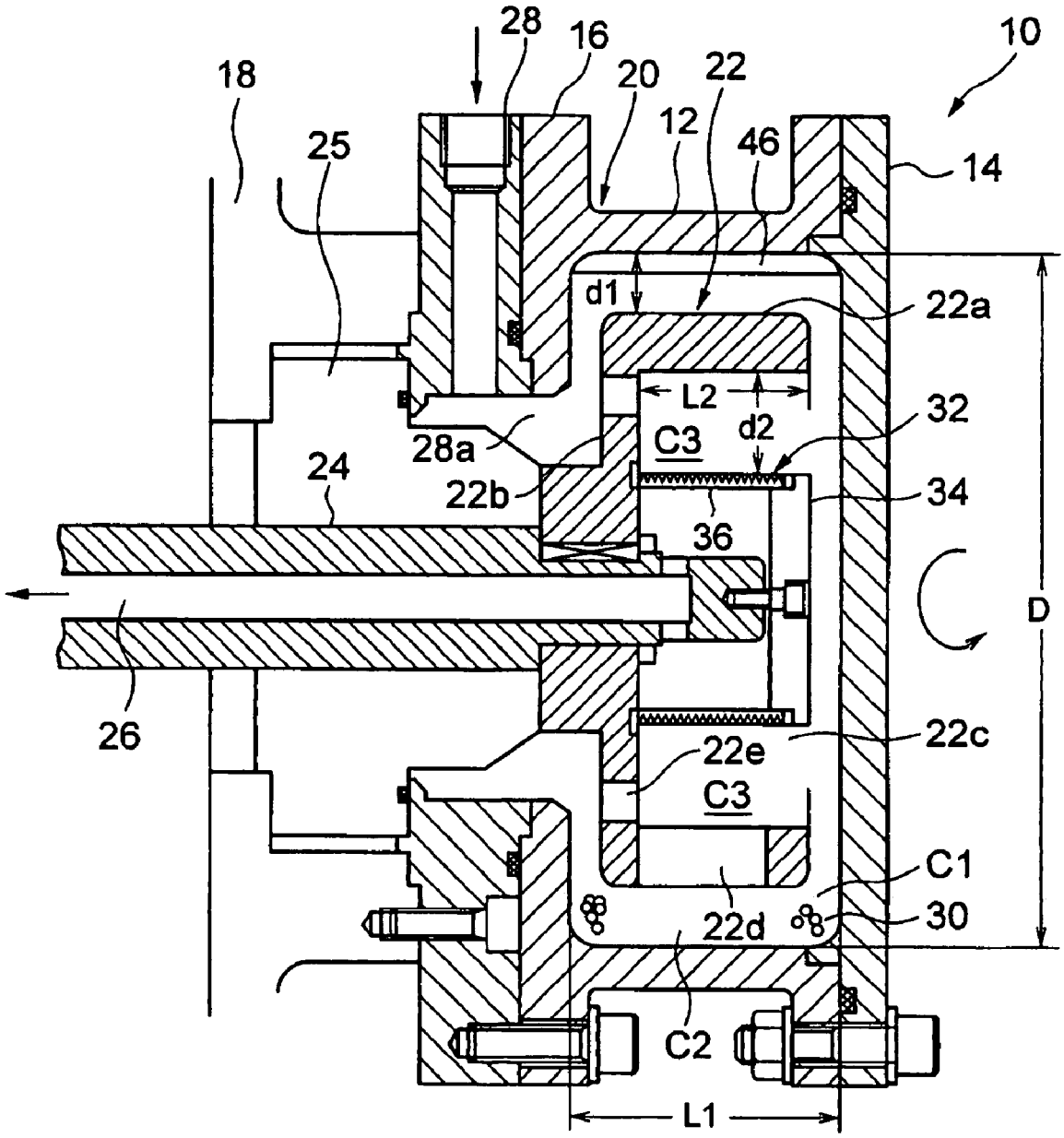
FIG. 1 is a longitudinal section of a circulation type media agitator mill according to one embodiment of the present invention.

Referring to FIG. 1, a circulation type media agitator mill or slurry-circulating and grinding media-agitating type of agitator mill 10 according to the first embodiment of the present invention includes a vessel 20 comprising a cylindrical barrel 12, an end plate 14 fixed to one end of the barrel 12, an inlet flange 16 fixed to the other end of the barrel 12 and a frame 18 fixed through the inlet flange 16. The vessel 20 defines a hermetically sealed vessel chamber C1 inside, whose lateral length-to-diameter ratio (L1/D) is smaller than one, preferably in the 0.3 to 0.4 range. For the lateral length-to-diameter ratio larger than one (L1/D>1) the bead-like grinding media is liable to cohere in the axial direction, thereby causing unusual wearing or heat generation in the barrel 12. For the lateral length-to-diameter ratio smaller than one (L1/D<1) the bead-like grinding media can be kept dispersive while moving.

A rotary agitating member 22 is rotatably mounted in the barrel 12. The agitating member 22 is a hollow cylinder having a cylindrical wall 22*a* at periphery which is closed on one side by an annular hub 22*b*, and is formed open 22*c* on the other side, and the agitating member 22 has a rotary drive shaft 24 fixed at the center of the annular hub 22*b*. The rotary drive shaft 24 passes through the frame 18 in the axial direction and the end of the shaft is connected to a drive motor via a known associated drive mechanism (not shown) and can rotate in the direction as indicated by arrow. The drive shaft 24 is rotatably fixed to the frame 18 via a mechanical sealing 25. An annular grinding chamber C2 (vessel chamber C1) is defined between the cylindrical wall 22*a* of the agitating member 22 and the surrounding cylindrical wall of the barrel 12. The inlet flange 16 has a material inlet 28 to lead into the grinding chamber C2 a slurry-like material substantially consisting of a carrier liquid mixed with pulverized material to be ground. The material inlet channel 28*a* is preferably laid behind the annular hub 22*b* of the agitating member 22. As is well known, the grinding chamber C2 contains a bead-like grinding media 30 for rubbing the pulverized material in the slurry.

In the agitating member 22, a media-separating member 32 is arranged coaxial with the cylindrical wall 22*a* of the agitating member to separate the bead-like grinding media 30 from the slurry-like material. A media separating chamber C3 is defined a space between the media-separating member 32 and the surrounding cylindrical wall 22*a* of the agitating member 22. In the separating chamber C3 the slurry-like material can be separated from the bead-like grinding media 30. The rotary drive shaft 24 has its axial hollow channel opening to the inner space of the media-separating member 32, thereby providing a material outlet 26 to discharge outside of the vessel 20 the slurry-like material with its pulverized material finely crushed.

Figure 3:
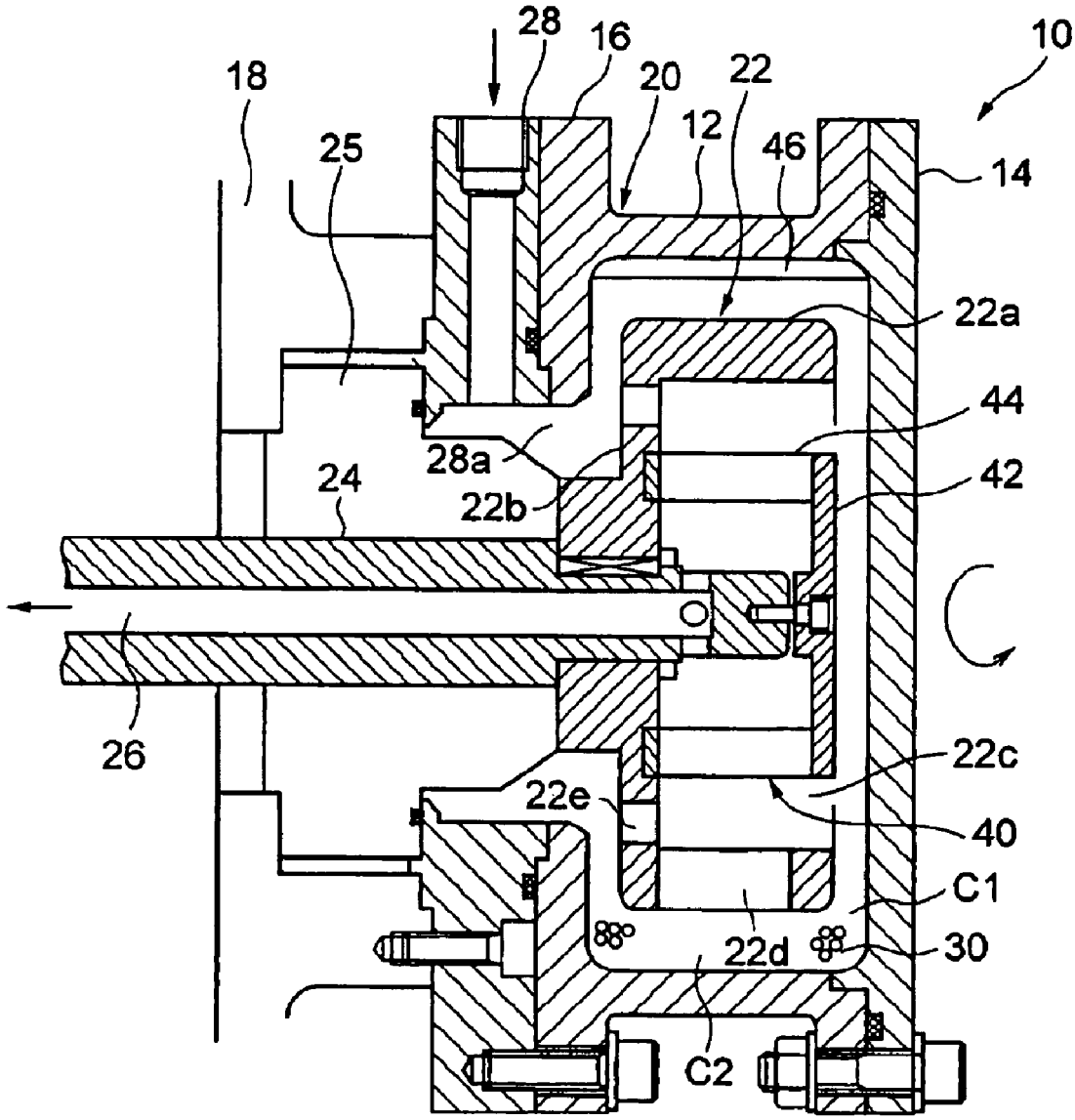
FIG. 3 is a longitudinal section of a similar mill whose media separating member is different from the counter part in FIG. 1.

The media-separating member 32 may be of a screening type (32 in FIG. 1) or of a centrifugal vaned wheel type (40 in FIG. 3). The screening type of separator is appropriate for separating ground material of relatively high viscosity from bead-like media of relatively large-sized grains whereas the centrifugal vaned wheel is appropriate for separating ground material of relatively low viscosity from bead-like media of relatively small-sized grains.

Figure 4:
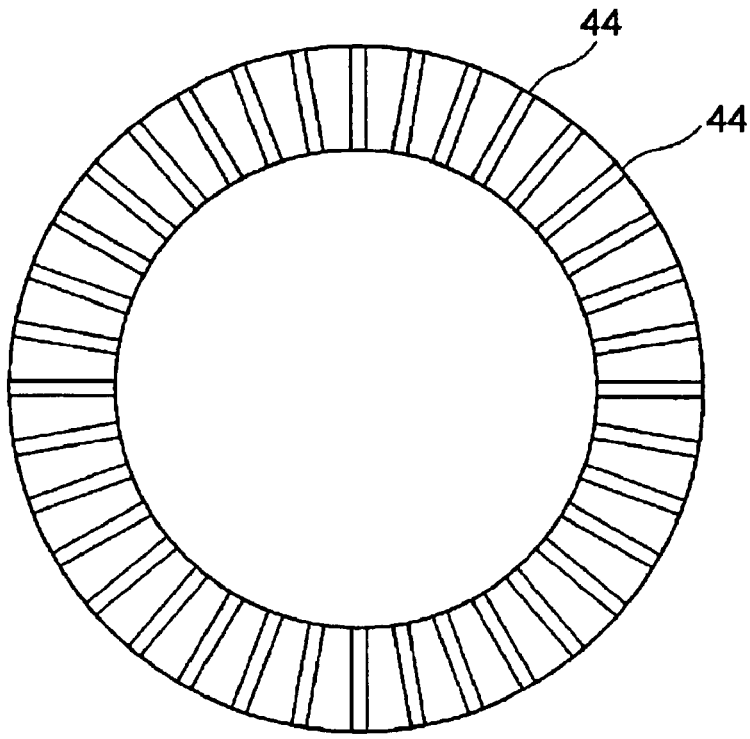
FIG. 4 is a longitudinal section of one example of the media separating member of the same type as used in the mill of FIG. 3.
Figure 5:
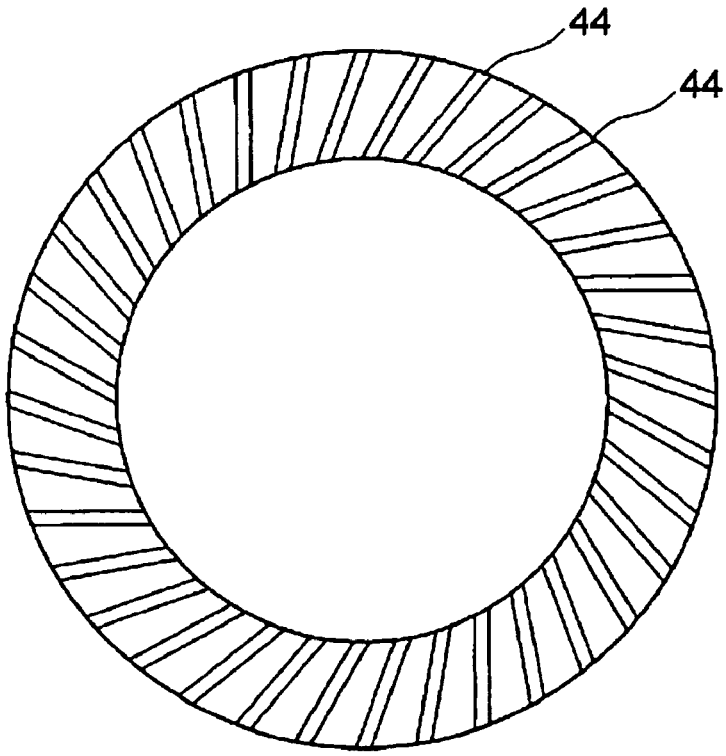
FIG. 5 is a longitudinal section of another example of the media separating member of the same type as used in the mill of FIG. 3.
Figure 8:
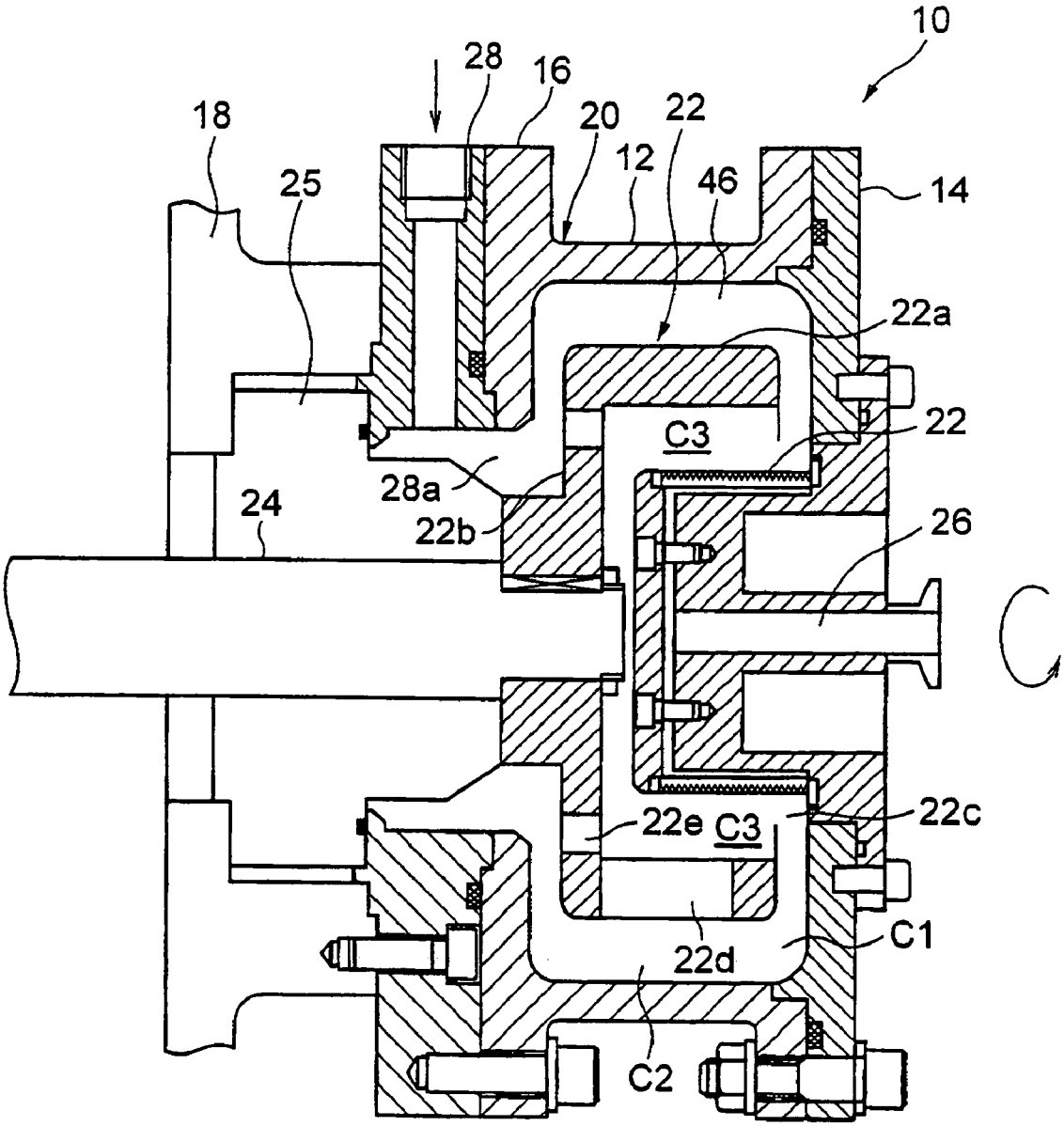
FIG. 8 is a longitudinal section of a circulation type media agitator mill according to another embodiment of the present invention, of which the media separating member and outlet are different from the counter part of the mill of FIG. 1.
Figure 9:
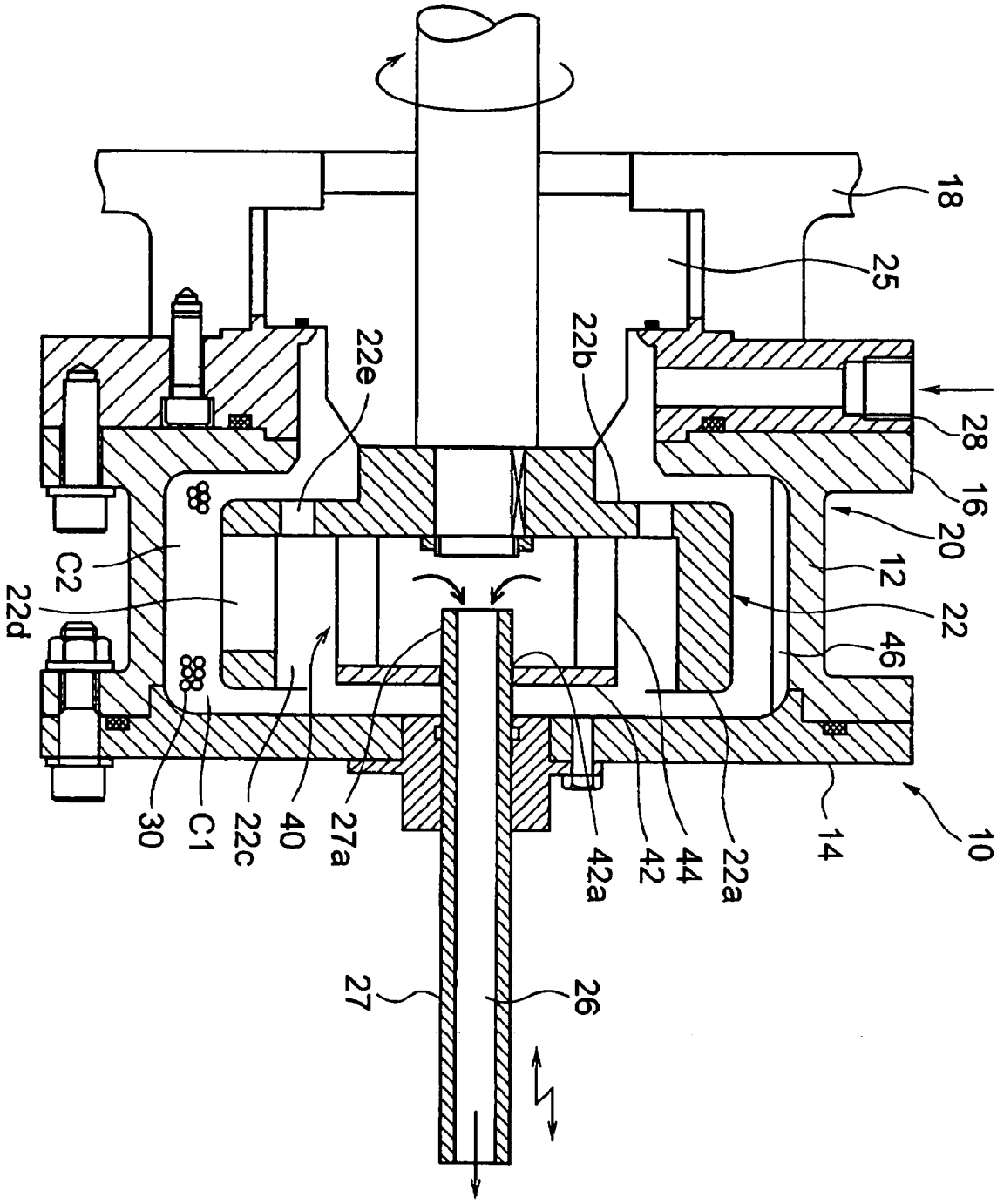
FIG. 9 is a longitudinal section of an agitator mill according to still another embodiment of the present invention, the outlet of which is different from the counter part of the mill of FIG. 3.

The screening type of media-separating member 32 has an end plate 34 fixedly arranged in confronting relation with the annular hub 22*b*, and a screen separator 36 arranged circumferentially between the annular hub 22*b* and the end plate 34. In this particular embodiment the media-separating member 32 is so fixed to the agitating member 22 as being rotatable together, but as shown in FIG. 8, the media-separating member may be so fixed to the end plate 14 of the vessel 20 as being stationary, extending inward into the agitating member 22. Then, the material outlet 26 is provided on the side of the end plate 14 of the vessel 20 as seen from FIG. 8. As for the centrifugal vaned wheel type of media-separating member 40 (see FIG. 9) an end plate 42 is fixedly arranged in confronting relation with the annular hub 22*b* of the agitating member 22, and a plurality of vanes 44 are arranged circumferentially at regular intervals between the annular hub 22*b* and the end plate 42. These vanes 44 may be arranged in radial directions as seen from FIG. 4, or in swirling directions as seen from FIG. 5. The media-separating member 40 of the centrifugal vaned wheel type is fixed to the agitating member 22, but the outlet 26 for finely crushed and screened material can be provided on the side of the end plate 14 of the vessel 20 as seen from FIG. 9. The end plate 42 of the media-separating member 40 has a circular opening 42*a* at its center, and a conduit 27 is loosely fitted in the center opening 42*a* to provide the outlet 26 as a stationary part. Preferably the conduit 27 is arranged coaxial with the rotary drive shaft 24 of the agitating member 22, and an inner end 27*a* of the conduit 27 passes through the opening 42*a* provided at the end plate 42 of the vaned wheel 40 and locates in the media-separating member 40, thereby allowing the slurry material finely crushed and screened from media material along with the carrier liquid to flow in the outlet 26.

Figure 2:
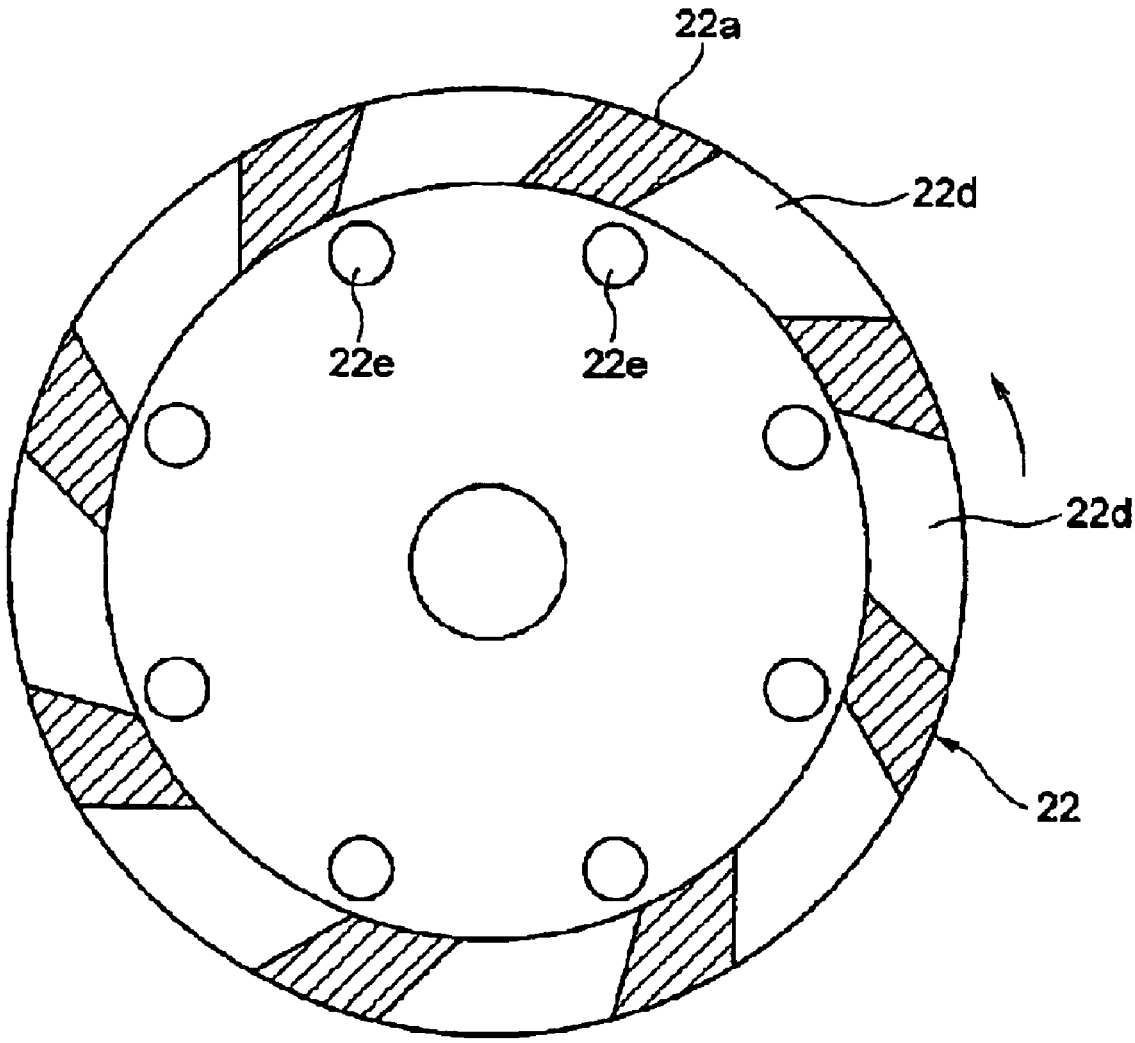
FIG. 2 is a cross section of the agitating member used in the mill of FIG. 1.

The cylindrical wall 22*a* of the agitating member 22 has a plurality of openings 22*d* made circumferentially at regular intervals for circulation of the bead-like grinding media, as seen from FIG. 2. Preferably these openings 22*d* are somewhat inclined relative to the rotating direction of the agitating member 22 as indicated by arrow. Likewise, a plurality of openings 22*e* are made circumferentially in the annular hub 22*b* of the agitating member 22 at regular intervals for circulation of bead-like grinding media, as seen from FIG. 2. The media separating chamber C3 communicate with the grinding chamber C2 by these media circulation openings, thus permitting the bead-like grinding media 30 to move freely from the inner space of the agitating member 22 to the surrounding grinding chamber C2. With this arrangement the mobility of the bead-like media is substantially improved, and accordingly the grinding efficiency is increased. As mentioned earlier, the vessel 20 is so designed that its L1/D ratio is below one, thereby preventing the localizing of the slurry and bead-like media, and keeping them evenly dispersed. Particularly the openings 22*e* made in the annular hub 22*b* help expedite the circulation of the bead-like media.

Figure 6:
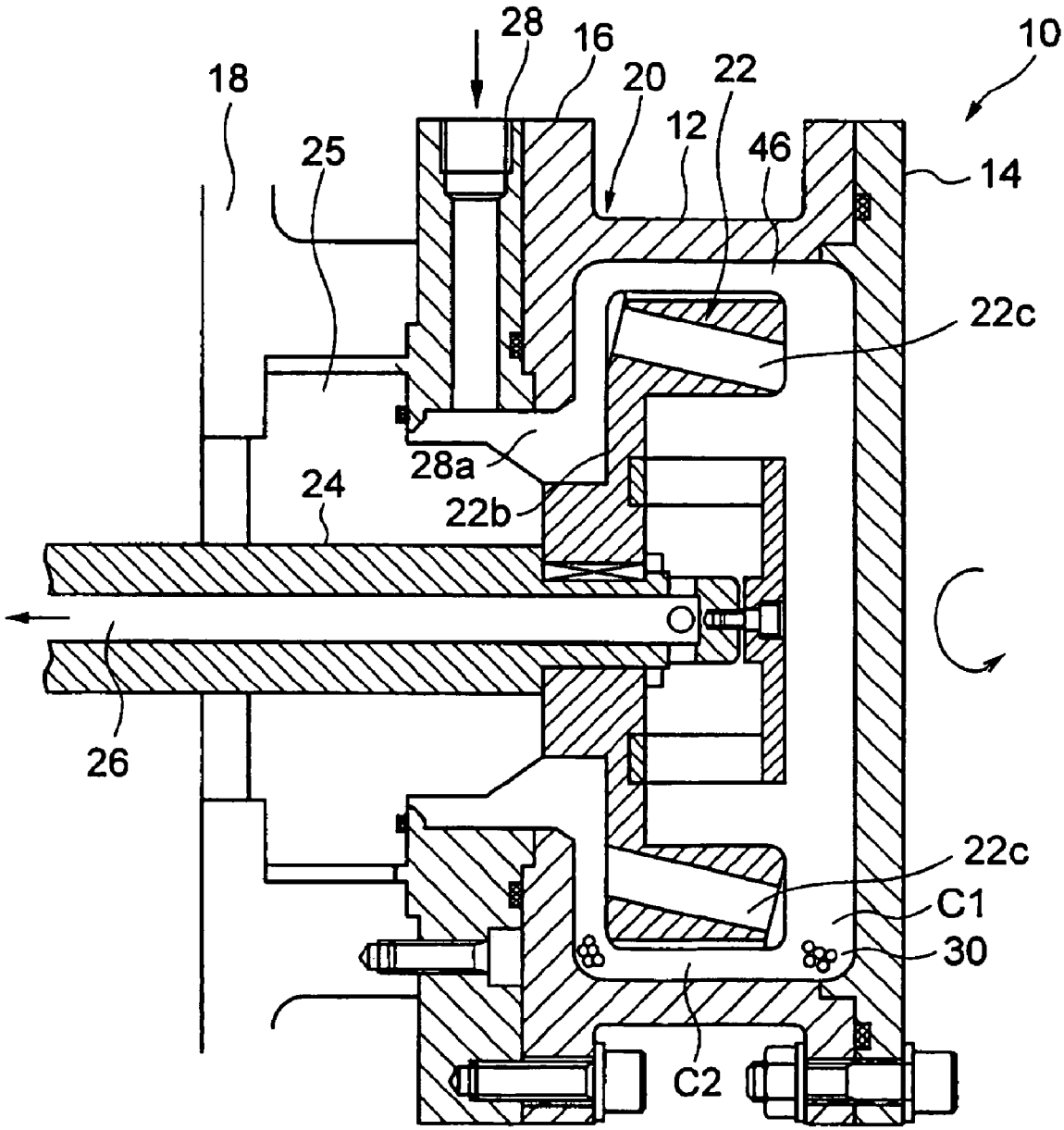
FIG. 6 is a longitudinal section of a similar mill whose agitating member is different from the counter part in FIG. 3.
Figure 7:
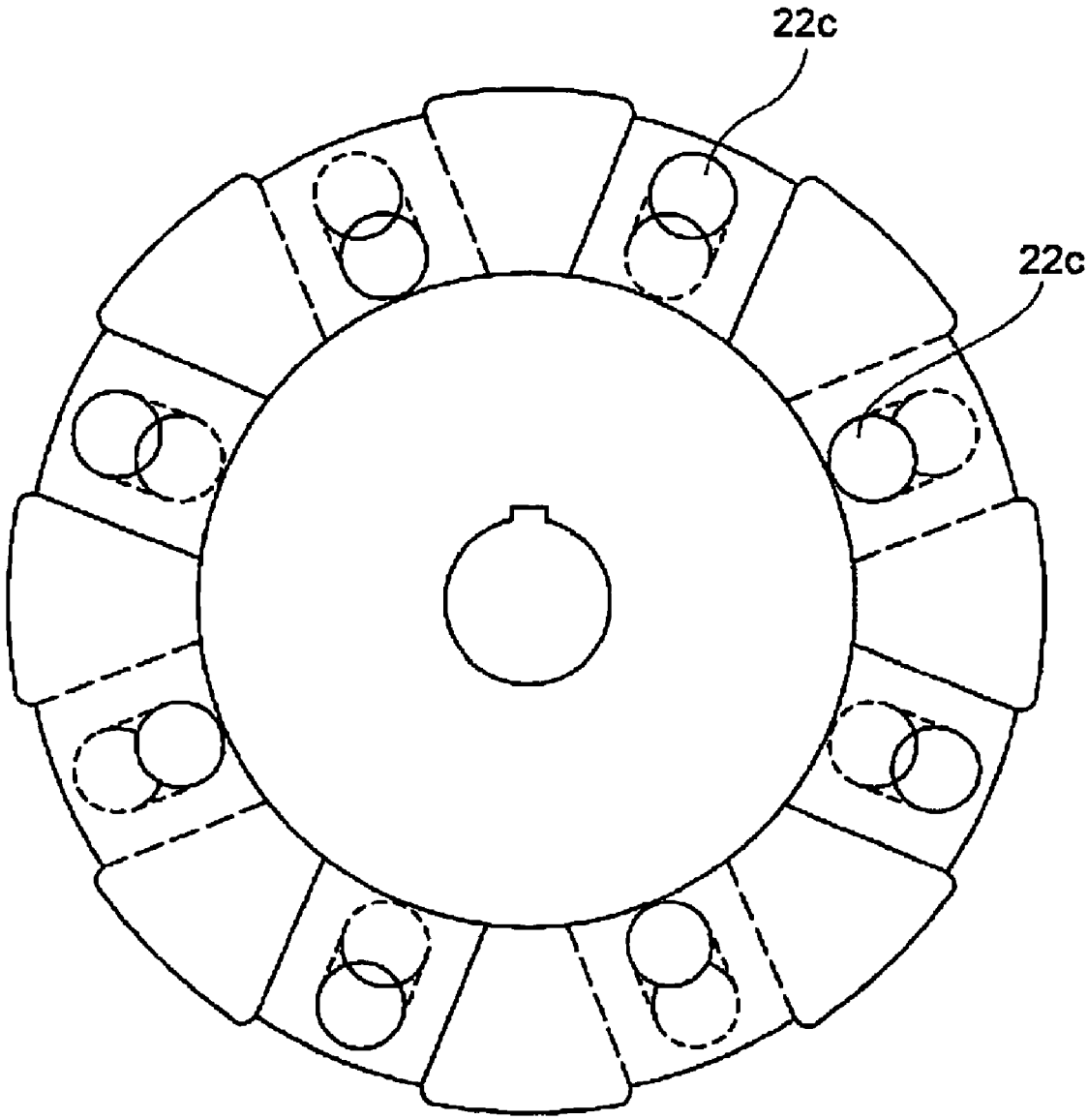
FIG. 7 is a front view of the agitating member used in the mill of FIG. 6.

In an attempt to still expedite the circulation of bead-like grinding media a plurality of oblique through holes 22*c* are made in the cylindrical wall 22*a* of the agitating member 22, extending from the front side of the free end of the cylindrical wall 22*a* to the rear side of the annular hub 22*b* of the agitating member 22, as seen from FIGS. 6 and 7. As seen from FIG. 7, the oblique through holes are preferably inclined alternately at same slant angle. As mentioned earlier, the vessel 20 is so designed that its L1/D ratio is below one, thereby providing the advantage of increasing the rotating speed of the agitating member 22. The centrifugal force, however, can be so increased as pushing the bead-like media against the vessel 20, thus restricting the free movement of the bead-like grinding media and ending up rotating together. The oblique through holes 22*c* helps drive the bead-like media in the axial direction, preventing the co-rotation phenomenon, and the high-speed rotation being permitted. Movement of the bead-like media 30 on the inner wall of the vessel 20 can be controlled by baffles 46, which are fixedly arranged on the inner wall of the vessel 20 as seen from FIGS. 1 and 3. Specifically the slippage otherwise caused there can be reduced to possible minimum, keeping the bead-like grinding media 30 mixed well with the slurry material. Accordingly the grinding effect is increased. Still advantageously the wearing of the vessel 20 can be minimized, and the agitating member 22 can be rotated at still higher speed.

Preferably the media agitator mill 10 is so designed that the ratio of the lateral length L2 of the media-separating chamber C3 to the lateral length L1 of the vessel chamber C1 of the vessel 20 (L2/L1) is in the 0.4 to 0.7 range. For the ratio of L2/L1 beyond the upper limit of the range the media agitator mill cannot structurally hold itself, and for the ratio of L2/L1 below the lower limit of the range the bead-like grinding media will lose its mobility.

Preferably the ratio of the width d2 of the annular media separating chamber C3 to the width d1 of the annular grinding chamber C2 (d2/d1) is in the 0.5 to 2 range. For the ratio of d2/d1 beyond the upper limit of the range the vessel chamber cannot be effectively used space, and for the ratio of d2/d1 below the lower limit of the range the bead-like grinding media cannot move freely.

Figure 10:
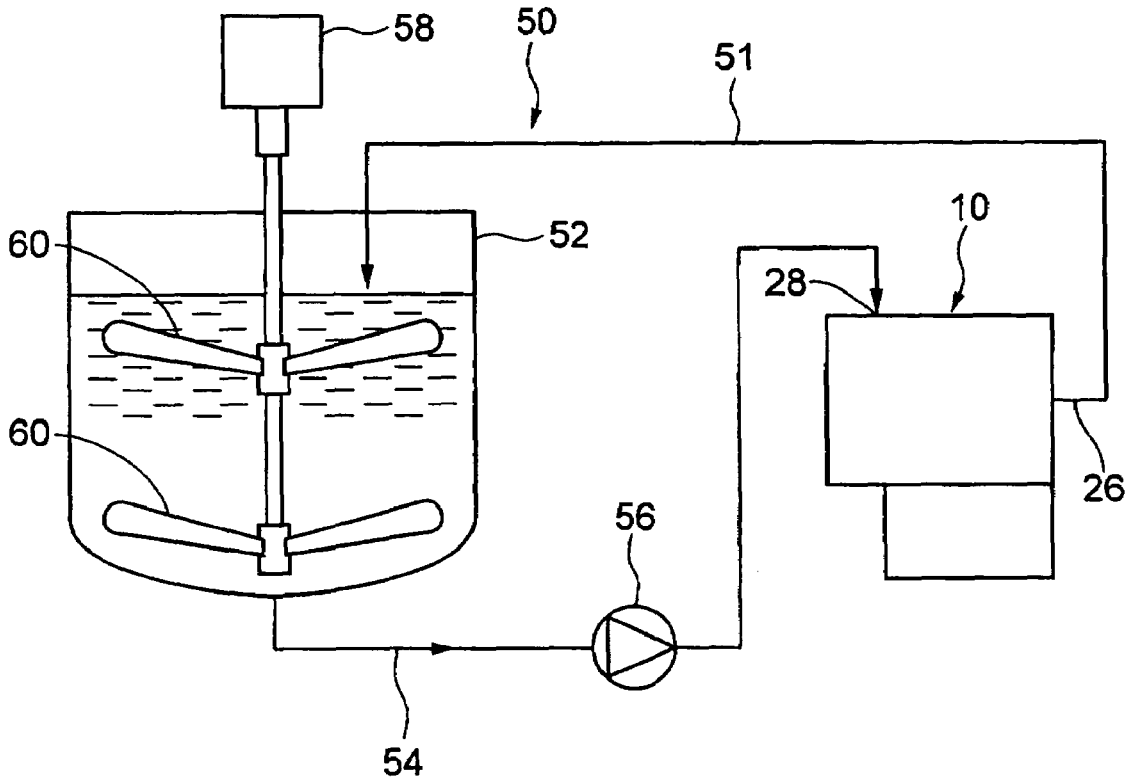
FIG. 10 is schematic view showing how the circulation type media agitator mill works.

FIG. 10 illustrates one mode of operation in which the mill 10 works. Specifically its outlet 26 and inlet 28 are connected in circuit with the circulation system 50, thereby gradually crushing and dispersing the pulverized material in the slurry while the carrier liquid is circulating. The pipe 51 of the circulation system 50 is connected at one end to the material outlet 26 of the media agitator mill 10, and is connected at the other end to a slurry tank 52, opening to the top of the slurry tank 52. Another pipe 54 is connected at one end to the bottom of the slurry tank 52, and is connected at the other end to the material inlet 28 of the media agitator mill 10 via a pump 56. The slurry tank 52 has a rotary agitating vane 60 connected to an electric motor 58. With this arrangement the slurry can be circulated in the mill 10 repeatedly until all the pulverized material has been crushed or ground to a desired fine grain size.

In operation a slurry substantially consisting of a carrier liquid mixed with material to be ground is put in the material inlet 28 of the mill 10, and the agitating member 22 is rotated. The slurry material introduced into the grinding chamber C2 is agitated along with the bead-like grinding media 30 there, rotating and rubbing all together. As is well known, the rotation of the bead-like grinding media causes the material to be crushed and dispersed in the slurry in the grinding chamber C2. The slurry along with the accompanying bead-like grinding media 30 enter from the open 22*c* to the inner space, i.e. the media separating chamber C3, where the slurry and bead-like grinding media is rotated along with the media separating member 32. The rotary motion allows the bead-like media of particles of relatively heavy weight and large size to move outward in radial directions, thus returning to the grinding chamber C2 through the circulation holes 22*d*, 22*e* of the cylindrical wall and annular hub of the agitating member. Pulverized material of particles still remaining at relatively large size because of insufficient grinding is allowed to behave like the bead-like grinding media. The slurry whose pulverized material has been well crushed or ground to a desired small grain size, and hence is reduced in weight and size, can pass through the screen net of the screening separator or the inter-vane spaces of the centrifugal vaned wheel, and can be discharged from the material outlet 26 of the rotary drive shaft 24. Thus, the grain size of the pulverized material when discharged from the material outlet can obtain in the very narrow dispersion range.

What is claimed is:

1. A circulation type media agitator mill comprises: a cylindrical vessel; an agitating member arranged rotatably in the cylindrical vessel, the agitating member including a cylindrical wall and a hub closing one end of the cylindrical wall at periphery, the other end of the cylindrical wall being opened, grinding media contained in a grinding chamber defined between the cylindrical wall of the agitating member and a surrounding cylindrical wall of the vessel; a media-separating member arranged coaxial with the agitating member in the inner space of the agitating member; an inlet for leading material to be ground to the grinding chamber, said inlet opening radially into said cylindrical vessel and located axially displaced from said agitating member; an outlet for leading to the outside of the mill the material which is treated in the grinding chamber, introduced into a media separating chamber formed between the agitating member and the media separating member and separated from the grinding media by the media separating member, and a circulation passage outside the mill, extending from the inlet to the outlet of the mill, in which the vessel is designed that the quotient of the length L1 divided by the diameter D of the vessel (L1/D) is in the 0.3 to 0.4 range, wherein the quotient of the length L2 of the media separating chamber divided by the length L1 of the vessel (L2/L1) is in the 0.4 to 0.7 range, and wherein the quotient of the annular width d1 of the grinding chamber divided by the annular width d2 of the media separating chamber (d2/d1) is in the 0.5 to 2 range, the cylindrical wall and hub of the agitating member have a plurality of openings to make the grinding chamber communicate with the media separating chamber.

2. A circulation type media agitator mill according to claim 1 wherein the cylindrical vessel comprises a cylindrical barrel, an end plate fixed to one end of the barrel, and a frame fixedly arranged on the other side of the barrel, the rotary drive shaft of the agitating member being fixed by one end to the agitating member, the other end of the shaft extending through the frame of the cylindrical vessel.

3. A circulation type media agitator mill according to claim 1 wherein the media-separating member is a vaned wheel.

4. A circulation type media agitator mill according to claim 1 wherein the inlet is behind the agitating member.

5. A circulation type media agitator mill according to claim 1 wherein the cylindrical vessel has a plurality of baffles laid on its inner cylindrical wall surface.

6. A circulation type media agitator mill for circulating and agitating a slurry substantially consisting of a carrier liquid mixed with pulverized material to be ground comprising: a cylindrical vessel; an agitating member arranged rotatably in the cylindrical vessel, the agitating member comprising a cylindrical wall and a hub, the cylindrical wall being integrally connected to a shaft via the hub to define an annular grinding chamber between the cylindrical wall of the agitating member and the surrounding cylindrical wall of the vessel, in which grinding chamber a grinding media is contained for rubbing and grinding the pulverized material in the slurry; an inlet for leading the slurry to the grinding chamber, said inlet opening radially into said cylindrical vessel and located axially displaced from said agitating member; a media-separating member fixed coaxial with the shaft of the agitating member to define a media separating chamber between the cylindrical wall of the media-separating member and the surrounding cylindrical wall of the agitating member, in which media separating chamber the fine-ground particles of the pulverized material can be separated from the grinding media; an outlet for leading the fine-ground particles-and-carrier liquid mixture from the media separating chamber to the outside of the mill; and a circulation passage outside the mill, extending from the inlet to the outlet of the mill, the cylindrical wall and hub of the agitating member having a plurality of openings to make the grinding chamber communicate with the media separating chamber, and the vessel being so designed that the quotient of the length L1 divided by the diameter D of the vessel (L1/D) may be in the 0.3 to 0.4 range, wherein the quotient of the length L2 of the media separating chamber divided by the length L1 of the vessel (L2/L1) is in the 0.4 to 0.7 range, and wherein the quotient of the annular width d1 of the grinding chamber divided by the annular width d2 of the media separating chamber (d2/d1) is in the 0.5 to 2 range.

* * * * *